US010226132B2

(12) United States Patent
Broom et al.

(10) Patent No.: US 10,226,132 B2
(45) Date of Patent: Mar. 12, 2019

(54) ADJUSTABLE BED

(71) Applicant: INTEGRATED FURNITURE TECHNOLOGIES LIMITED, Cheltenham, Gloucestershire (GB)

(72) Inventors: Gary Broom, Bradford (GB); Chris Walker, Bradford (GB)

(73) Assignee: INTEGRATED FURNITURE TECHNOLOGIES LIMITED, Gloucestshire (GB)

( * ) Notice: Subject to any disclaimer, the term of this patent is extended or adjusted under 35 U.S.C. 154(b) by 283 days.

(21) Appl. No.: 15/023,267

(22) PCT Filed: Sep. 17, 2014

(86) PCT No.: PCT/GB2014/000372
§ 371 (c)(1),
(2) Date: Mar. 18, 2016

(87) PCT Pub. No.: WO2015/040359
PCT Pub. Date: Mar. 26, 2015

(65) Prior Publication Data

US 2016/0262548 A1 Sep. 15, 2016

(30) Foreign Application Priority Data

Sep. 20, 2013 (GB) ..... 1316684.8

(51) Int. Cl.
*A47C 20/04* (2006.01)
*A47C 19/00* (2006.01)
(Continued)

(52) U.S. Cl.
CPC ..... *A47C 20/04* (2013.01); *A47C 19/005* (2013.01); *A47C 19/021* (2013.01); *A61G 7/015* (2013.01)

(58) Field of Classification Search
CPC ..... A61G 7/015; A61G 7/002; A47C 20/041; A47C 19/005
See application file for complete search history.

(56) References Cited

U.S. PATENT DOCUMENTS 139,493 A 6/1873 Bray
638,466 A 12/1899 Kelly
(Continued)

FOREIGN PATENT DOCUMENTS

CA 851 402 9/1970
CN 202314169 7/2012
(Continued)

OTHER PUBLICATIONS

GB 1316684.8, International Search Report and Written Opinion, 7 pages—English.
(Continued)

*Primary Examiner* — Eric J Kurilla
(74) *Attorney, Agent, or Firm* — Andrew F. Young, Esq.; Lackenbach Siegel, LLP

(57) ABSTRACT

The invention concerns an adjustable bed comprising a frame and at least one adjustable body support section including an adjustable backrest support section pivotally mounted for angular adjustment with respect to the frame. The frame comprises at least two sections including an upper body section on which the back rest is mounted and a separate lower body section. The upper and lower body sections are capable of being joined together to provide a full length adjustable bed. The invention provides an adjustable bed that can be stored and transported in two parts (plus mattress), which provides for ease of storage, display, delivery and installation.

12 Claims, 9 Drawing Sheets

(51) Int. Cl.
*A47C 19/02* (2006.01)
*A61G 7/015* (2006.01)

(56) References Cited

U.S. PATENT DOCUMENTS 912,214 A 2/1909 Ward
1,238,078 A 8/1917 Ault
1,414,637 A 5/1922 Gell
2,177,202 A * 10/1939 Berge ..... B60N 2/34 16/375
2,954,072 A 9/1960 Fossati
3,036,862 A 5/1962 Beierbach et al.
3,086,814 A 4/1963 Fletcher
3,121,589 A 2/1964 Schliephacke
3,202,453 A 8/1965 Richards
3,369,767 A 2/1968 Greenfield
3,797,050 A 3/1974 Benoit
3,873,152 A 3/1975 Garas
4,034,972 A * 7/1977 Peterson ..... A61G 7/015 5/488
4,202,062 A 5/1980 Marcyan
4,547,017 A 10/1985 Lescure
4,635,999 A 1/1987 Simpson
4,685,160 A * 8/1987 Rizzardo ..... A47C 19/005 5/201
4,970,737 A * 11/1990 Sagel ..... A47C 20/08 5/201
4,998,310 A * 3/1991 Olson ..... A47C 19/005 5/201
5,112,109 A 5/1992 Takada et al.
5,246,266 A 9/1993 Ostergaard
5,257,428 A * 11/1993 Carroll ..... A47C 19/122 5/201
5,785,384 A 7/1998 Sagstuen
5,819,345 A 10/1998 Basgall
5,897,462 A 4/1999 St. Germain
5,964,347 A * 10/1999 Urness ..... A47C 19/005 206/320
6,059,364 A 5/2000 Dryburgh et al.
6,101,648 A 8/2000 Sommerfeld et al.
6,357,065 B1 * 3/2002 Adams ..... A47C 19/04 5/611
6,568,755 B1 5/2003 Groening
6,641,214 B2 11/2003 Veneruso
6,739,661 B1 5/2004 Dukes
7,219,958 B2 5/2007 Yamazaki et al.
7,390,060 B2 6/2008 Kristen
7,445,279 B2 11/2008 Crum
7,641,277 B2 1/2010 Lawson et al.
7,703,851 B2 4/2010 Nakaya et al.
7,997,654 B2 8/2011 Ferry et al.
8,303,036 B2 11/2012 Hankinson et al.
8,403,415 B2 3/2013 Lawson
8,424,964 B2 4/2013 Campbell et al.
8,534,758 B2 9/2013 Rivera
9,351,584 B1 * 5/2016 Rizzardo ..... A47C 19/045
9,713,388 B2 * 7/2017 Goldsmith ..... A47C 19/005
9,757,294 B1 * 9/2017 Lo ..... A61G 7/015
9,844,273 B2 * 12/2017 Goldsmith ..... A47C 19/005
9,844,274 B2 * 12/2017 Goldsmith ..... A47C 19/005
9,918,556 B2 * 3/2018 Rawls-Meehan ..... A47C 20/04
2002/0060483 A1 5/2002 Yoshida et al.
2002/0069462 A1 * 6/2002 Gaboury ..... A47C 19/005 5/201
2002/0174487 A1 * 11/2002 Kramer ..... A61G 7/015 5/618
2003/0172455 A1 9/2003 Roma et al.
2004/0034934 A1 * 2/2004 Weinman ..... A47C 20/041 5/618
2004/0155504 A1 8/2004 Tada
2005/0011005 A1 * 1/2005 Borda ..... A47C 19/04 5/412
2005/0210588 A1 9/2005 Loewenthal
2005/0251917 A1 * 11/2005 Wall, Sr. ..... A47C 19/005 5/618
2007/0120409 A1 5/2007 Leeds
2007/0143922 A1 * 6/2007 Ganance ..... A61G 7/05 5/602
2007/0158980 A1 7/2007 LaPointe et al.
2007/0192960 A1 * 8/2007 Jackson ..... A61G 7/001 5/618
2008/0052830 A1 * 3/2008 Koughan ..... A47C 19/005 5/613
2008/0150329 A1 6/2008 Lawson
2009/0139029 A1 * 6/2009 Rawls-Meehan ..... A61G 7/015 5/617
2011/0248530 A1 10/2011 Sartisohn
2012/0168328 A1 * 7/2012 Chen ..... A47C 19/005 206/223
2014/0059769 A1 * 3/2014 Baker ..... A61G 7/015 5/613
2014/0201915 A1 * 7/2014 Ermalovich ..... A47C 20/08 5/613
2014/0201916 A1 * 7/2014 Ermalovich ..... A61G 7/015 5/618
2014/0259396 A1 * 9/2014 McCarty ..... A47C 19/005 5/400
2015/0121623 A1 * 5/2015 Huang ..... A47C 20/041 5/616
2016/0000621 A1 * 1/2016 Jackson ..... A61G 13/06 5/618
2016/0206113 A1 * 7/2016 Rawls-Meehan ..... A47C 20/04
2016/0286970 A1 * 10/2016 Robertson ..... A47C 20/041
2017/0042340 A1 * 2/2017 Chacon ..... A61G 5/14
2017/0086595 A1 * 3/2017 Chen ..... A47C 19/005
2017/0112716 A1 * 4/2017 Rawls-Meehan ..... A61H 23/04
2017/0234341 A1 * 8/2017 Packman ..... F16B 5/0084 312/108
2017/0258239 A1 * 9/2017 Xie ..... A47C 20/041

FOREIGN PATENT DOCUMENTS

DE 029715343 1/1998
DE 010152227 5/2003
DE 10 2007 024 218 11/2008
DE 102007024218 11/2008
EP 0781518 12/1996
EP 0865960 3/1998
EP 1 621 175 2/2006
GB 0101239 8/1916
GB 0329834 5/1930
GB 0414464 8/1934
GB 0775679 5/1957
GB 2227932 8/1990
GB 2486335 6/2012
GB 191322022 8/2014
JP 36-13946 5/1936
JP 08-173263 7/1996
JP 08-308680 11/1996
JP 11-244096 9/1999
JP 2003-144262 5/2003
WO WO 96/29970 10/1996
WO WO 2005/051128 6/2005
WO WO 2006/023447 3/2006
WO WO 2007/124067 11/2007
WO WO2008027906 3/2008
WO WO-2008027906 A2 * 3/2008 ..... A47C 19/005
WO WO/2011/021002 2/2011
WO WO 2012/032305 3/2012
WO WO 2014/183112 11/2014
WO WO 201/5011432 9/2015

OTHER PUBLICATIONS

Pat. No. GB 1417108.6, Combined Search and Examination Report dated Mar. 26, 2015, 7 pages—English.
EasyCliner® wood-to-the-floor recliner mechanism, 1 page, HomeFurnitureComponents.com, Apr. 10, 2015.
GB1313002.6, Search Report dated Jan. 21, 2014, 4 pages.
PCT/GB2014/000274, Written Opinion dated Jan. 21, 2014, 5 pages.

(56) References Cited

OTHER PUBLICATIONS

U.S. Appl. No. 13/390,985, filed Feb. 17, 2012, Office Action dated Jan. 7, 2015, 20 pages.
PCT/GB2010/001565 International Search Report dated Apr. 12, 2011, 6 pages—English.
EP 14 781 614.4, Examination Report dated Jul. 2, 2018, 4 pages—English.

* cited by examiner

ADJUSTABLE BED

CROSS REFERENCE TO RELATED APPLICATIONS

This application relates to as a § 371 national phase to Ser. PCT/GB2014/000372 filed Sep. 17, 2014, the entire contents of which are incorporated herein by reference, which in turn claims priority to GB Ser. No. 1316684.8 filed Sep. 20, 2013.

BACKGROUND OF THE INVENTION

Field of the Invention

This invention relates to an adjustable bed having adjustable body support sections which can be moved to adjust the configuration of the bed.

Description of the Related Art

Adjustable beds are known, for example, from US2002/0174487, the contents of which are incorporated by reference, which discloses a hospital bed having adjustable back and thigh sections. The hospital bed of US2002/0174487 comprises a frame having a pair of parallel and spaced apart first and second side frame members; a mattress support deck including an adjustable back section having first and second sides; a fixed seat section located adjacent to the back section and an adjustable thigh section located adjacent to the seat section, and movable relative to the seat section to increase the length of the thigh section as the thigh section is raised relative to the frame. First and second curved tubes are coupled to respective first and second sides of the back section. A plurality of rollers are coupled to the first and second side frame members, with the rollers being configured to support the first and second curved tubes to permit movement of the curved tubes and the back section relative to the frame. A linear actuator is disposed beneath the back section and coupled to the first and second tubes to move the back section from a horizontal position to an elevated position relative to the frame. Two concentric acruate tubes are provided on each side of the bed which have a radius of curvature centered on a location which emulates the natural hip pivot of a person lying on the mattress of the bed. The tubes are secured between three rollers on each side of the bed. Two rollers are located on a bottom side of the radially outer tube, that is to say radially outwards thereof, and the third roller is located on a top side of the radially inner tube. A pair of cross-members extend between the tubes. The arrangement provides a so called shear-less pivot mechanism in which the adjustable back section pivots about the natural hip point of the person on the bed.

The arrangement disclosed in US2002/0174487 may be considered heavy, robust and mechanically complex. This structure, while suitable for hospital beds, does not readily provide an arrangement that is suitable for more lightly used domestic furniture, where other design considerations, such as weight and cost, come into play.

An adjustable bed particularly suitable for domestic furniture applications is described in WO2011/048384, the contents of which are incorporated by reference. This bed comprises a mattress support deck having a plurality of mattress support sections, including a movable back support section, a fixed seat section adjacent to the back support section, a movable thigh support section adjacent the seat section and a movable foot or lower leg support section adjacent and hinged to the thigh support section. The back and thigh support sections are mounted with respect to the base to allow angular adjustment of their relative positions to alter the configuration of the bed. Linear actuators are provided for moving each of the movable sections to effect angular adjustment of the bed. A pair of load-bearing arcuate members are spaced apart on opposite lateral sides of both the back and thigh sections. The bearing members project from the underside of the respective support sections and are each provided with bearings arranged to run on a respective curved support provided in or on a respective side panel of the base. The bearing members are rigidly connected together by a suitable cross-member on the underside of the respective support sections. Each cross member provides a suitable attachment point for one end of a linear actuator. The arrangement provides a robust box-section type construction, the four sides of which are provided by the support section, typically a panel of board material, the two bearing members on opposite sides of the support section and the cross-member. This construction provides for rigidity that resists twisting of the structure and hence maintains alignment of the bearings and respective curved support guides in the side panels of the base.

One of the drawbacks of the bed disclosed in WO2011/048384 is that it does not readily lend itself to the logistics of the furniture industry, that it to say, it is not easy to store, transport, deliver and assemble, or at least as readily as existing non-adjustable beds of known designs.

ASPECTS AND SUMMARY OF THE INVENTION

There is a requirement for an adjustable bed which is mechanically less complicated than hitherto known designs and which has attendant weight and cost advantages. There is a particular requirement for an adjustable bed which is at least as easy to manufacture, store, transport, deliver and assemble as non-adjustable beds of known designs.

According to an aspect of the present invention there is provided an adjustable bed comprising: a frame and at least one adjustable body support section including an adjustable backrest support section pivotally mounted for angular adjustment with respect to the frame, characterized in that the frame comprises at least two sections including an upper body section on which the back rest is mounted and a separate lower body section, wherein the upper and lower body sections are capable of being joined together to provide a full length adjustable bed.

The above aspect of the invention provides a modular type adjustable bed in which the frame is split into at least two sections, preferably two sections, more preferably two half sections. This assists in storage, transportation, display, delivery and installation. An adjustable bed according to the present invention may therefore be assembled on site by simply joining the sections of the frame together. For example two sections of the bed may be delivered to a customer's home and readily maneuvered through standard size doorways and hallways into a bedroom where they can be joined together, end to end, to provide a full length frame on which a suitable mattress can be placed. This is a significant improvement over hitherto know designs of adjustable beds which typically comprise a kit of parts for assembly at the customer's home. This not only adds to the time of installation, but also requires more skilled labor for delivery and installation. The cost of distribution can be significantly reduced with adjustable beds of the above aspect of the invention, particularly as the bed frame may be transported and delivered as two complete sub-assemblies which can be readily joined together, both mechanically and electrically, by means of simple mechanical and electrical connectors as well known in the art. Significant savings can be made in terms of distribution to retailers as fewer packages are required to be transported. It is to be understood that the transportation of such goods by recognized carriers is often charged on a per item basis, hence the present invention also envisages lower distribution costs. The fact that the adjustable bed of the present invention can be easily assembled means that it can be as easily disassembled for moving to another room within the same house or elsewhere in the case of a house move. These considerations are a significant advantage over known arrangements which do not lend themselves to such easy assembly and disassembly. This is also a consideration in the retail industry where floor space for display purposes can be limited, and a retailer may be less inclined to introduce a new high end product such as an adjustable bed if the product is difficult to assemble correctly for demonstration and/or display purposes, as may be considered to be the case with many existing products.

Preferably, the upper body section further comprises a fixed support section adjacent to the backrest support section, the fixed support section being fixed in relation to the frame adjacent the hinged end of the backrest section to provide at least part of a fixed seat section of the bed. In this way the length of the backrest can be readily designed to co-operate with an adjacent fixed seat support section to provide appropriate support for the user.

In preferred embodiments, the lower body section comprises at least one adjustable body support section that is pivotally mounted for angular adjustment with respect to the frame. The modular nature of the adjustable bed according to the above aspect of the invention is particularly advantageous as it enables the upper body section of the frame with the adjustable backrest to be combined with a lower body section with or without adjustable sections. For example if an adjustable bed having only an adjustable back rest was required the bed would be delivered with a non-adjustable lower body frame section, that is to say a lower body frame section that is more akin to that of a standard divan bed than an adjustable bed. This could provide the opportunity of offering different versions of adjustable bed, one without any adjustment for raising and lowering the legs of the user or one with such additional functionality. Additionally, different versions of the lower body section may be provided, for example with or without drawers, which may be provided in the side of the base frame as in a conventional divan design or in the end as is known in existing adjustable bed designs, for example as manufactured by Sherborne Upholstery Limited (Applicant is the successor of interest).

The at least one adjustable body support section of the lower body section preferably comprises an adjustable upper leg/thigh support section and an adjustable lower leg/calf and foot support section. Thus, the adjustable bed contemplates embodiments that provide the same functionality as a typical hospital bed or high end domestic bed where the legs and feet of the user can be selectively raised and lowered independently of the position and motion of the backrest support section.

Preferably, the adjustable lower leg and foot support is pivotally connected to the leg upper leg/thigh support.

The lower leg/foot support is preferably arranged to pivot apart from the upper leg support during angular adjustment of the leg support section, and further comprising an abutment stop that prevents further angular adjustment of the lower leg/foot support section with respect to the upper leg support section at a predetermined angle of adjustment relative to the upper leg support section.

In preferred embodiments, the lower body section further comprises a fixed support section adjacent to the upper leg support section, the fixed support section being fixed in relation to the frame adjacent the hinged end of the upper leg section to provide at least part of a fixed seat section of the bed. In this way when the two parts of the frame are brought together the two seat sections, one each of the upper and the lower body section of the frame, are disposed adjacent one another and combine to provide a fixed seat section of an appropriate length between the adjustable backrest and upper leg support sections.

Preferably, the or each body support section comprises at least one bearing member projecting downwards therefrom, with the bearing member being supported by bearing means arranged to run on a curved guide such that the or each moveable body-support section is pivotally mounted with respect to the frame about a respective pivot axis defined by the centre of curvature of the respective curved guide(s). This readily enables the weight of the user to be supported by the bed frame with the load bearing structure of the frame being integrated in such a way that the weight carried by the adjustable sections of bed is readily transferred to the frame. The arrangement of the bearing member(s), bearing means and curved support readily enables the adjustable support sections to be moved, independently if necessary, about their respective pivot axis which may be offset from the frame.

In one embodiment, the bearing means is carried by the frame and the curved guide is provided on the bearing member. It is however possible to use a reverse arrangement in which the bearing means is carried on the bearing member and runs in a curved track in or on the frame. For example, in one embodiment, the bearing means is carried by the bearing member(s), and the curved guide is provided on or in (preferably a slot in) the frame. The or each curved guide may be provided on or in a respective side panel of the frame.

The bearing means may be of any appropriate kind, for example roller bearings mounted on a shaft.

Preferably, the bearing member comprises a curved guide and the or each body support section includes a pair of curved guides connected to respective opposite lateral sides of the adjustable support section, and the bearing means are connected to respective opposite lateral sides of the frame, the curved guides being arranged to run on the bearing means to permit angular adjustment about a pivot axis defined by the centre of curvature of curved guides, Preferably, the upper and lower body sections of the frame each comprises a box type frame having a pair of lateral side panels enclosing the respective interior region of the respective frame sections of the bed. The box frame structure provides an integrated structural frame for the base of the adjustable bed that is both strong and robust. The side panels not only provide an aesthetically simple design but also a physical guard around the side of the bed preventing inadvertent access to the moving parts and hence entrapment points on the underside of the bed. Aspects of the present invention envisage embodiments in which the side panels are upholstered as in the base of a typical divan bed.

Preferably, the said upper and lower body sections of the frame each comprises a box type frame having a pair of end panels closing the respective ends the respective frame sections of the bed. Thus, the sub-assembly frames can be closed at their respective ends. As with the side panels the end panels also provide a physical guard at the ends of the bed preventing inadvertent access to the moving parts and hence entrapment points in the bed. Aspects of the present invention envisage embodiments in which the end panels are also upholstered.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
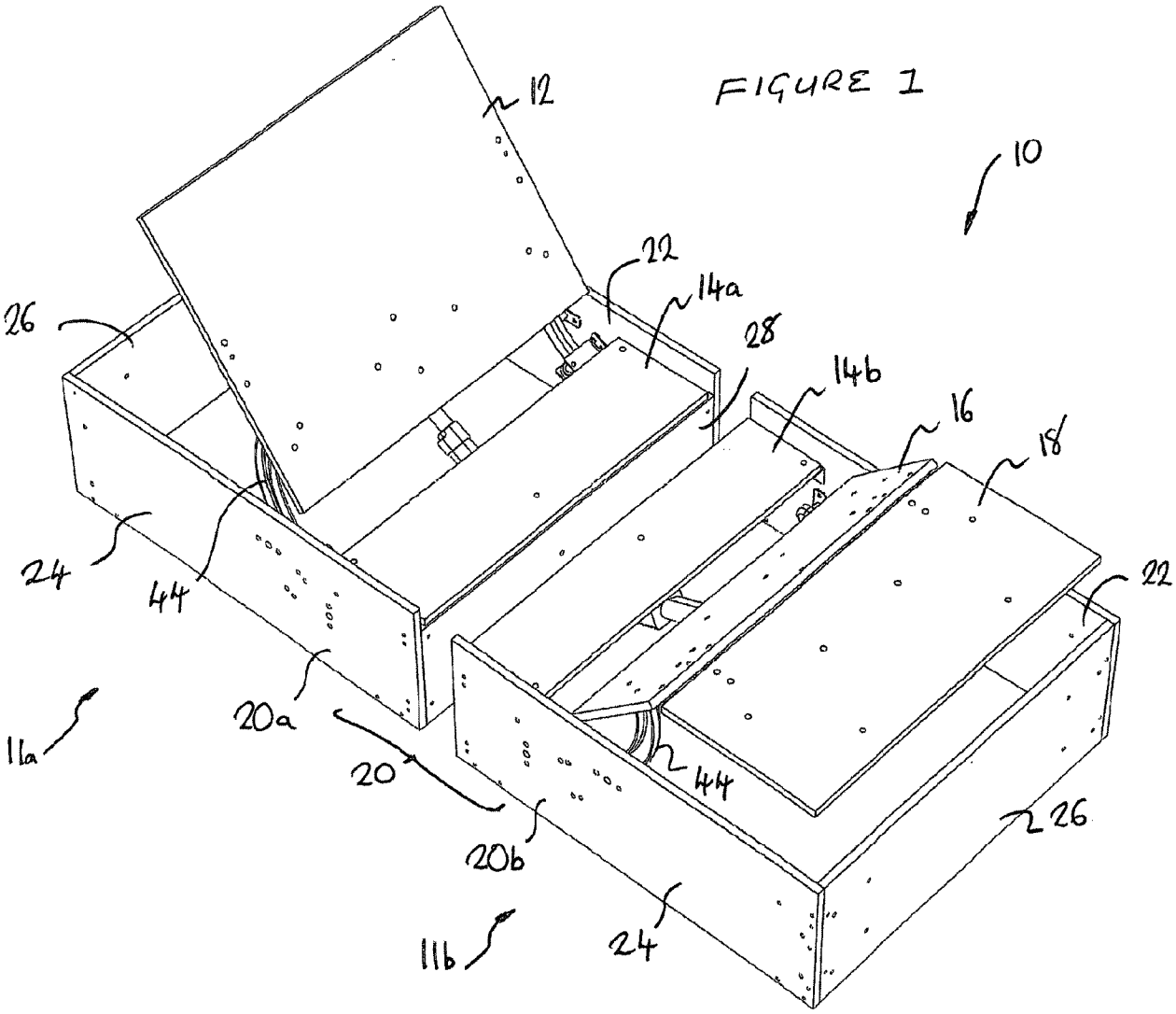
FIG. 1 is a perspective view from above and the front of an adjustable bed according to an embodiment of the invention, with the bed in a raised configuration.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Referring to the drawings, FIGS. 1 to 6 schematically show the frame of an adjustable bed 10 according to a first embodiment of the present invention. The bed 10 is in two halves, including a head end sub-assembly 11*a* and a toe end sub-assembly 11*b*. The two halves 11*a*, 11*b* are capable of being joined together at their respective adjacent ends to form an adjustable bed having an external appearance similar to that of known adjustable beds. It will be understood that in the drawings of FIGS. 1 to 6 the two halves are shown positioned end to end adjacent one another with a small gap separating the respective ends. The bed is shown with the two separate halves of the bed orientated for connection. The two halves 11*a* and 11*b* may be connected together with latches, clips or the like as the halves of a conventional divan bed base may be joined together.

The head end sub-assembly 11*a* comprises an adjustable back/head support panel 12 and a fixed seat section panel 14*a*. The toe end sub-assembly 11*b* comprises a fixed seat section panel 14*b*, an adjustable upper leg (thigh) support panel 16 and an adjustable foot and lower leg (calf) support panel 18.

The panels 12, 16 and 18 are each adjustably mounted on respective rectangular box type support frames 20*a*, 20*b*. The support frames 20*a*, 20*b* together constitute a floor standing base 20 of the bed 10. The fixed panels 14*a*, 14*b* are fixed to the respective support frames 20*a*, 20*b* at their respective adjacent ends so that the panels 14*a*, 14*b* are aligned adjacent to one another side by side when the two halves of the bed are joined together. The bed thus has the structure and appearance of a divan type bed having a typical box type mattress foundation which may be upholstered as is well known in the art.

In FIGS. 1 to 4 the bed 10 is shown in an upright configuration with the panels 12, 16 and 18 inclined with respect to the base to support a user in a raised seated position. In the lowered position of FIGS. 5 and 6 the body support panels 12, 16 and 18 lie substantially flat at the top of the base and combine with the respective fixed seat panels 14*a*, 14*b* to provide a continuous flat horizontal mattress support platform. The plane of the lowered platform is positioned just below the top edge 19 of the base which creates a recess 21 within the region bounded by the side and end panels of the base as will be described in more detail below.

The fixed and adjustable body support panels 12, 14*a*, 14*b* 16, and 18, may include or be provided with upholstered cushions/pads (not shown) or the like on their respective upward facing surfaces for supporting a mattress (also not shown) positioned on top of the cushions or pads. Alternatively a mattress may be positioned directly on top of the panels. The bed 10 is a single size bed but the present embodiment contemplates beds of many different widths including standard single size beds to much larger doubles.

The base section support frames 20*a*, 20*b* each comprise a generally rectangular structural frame constructed from a board type material, for example an engineering plastic, wood, MDF or other suitable board material. Each base section support frame includes a pair of elongate parallel lateral side panels 22, 24 which are joined together at the respective ends by end panels 26, 28 to form a rectangular box type load bearing structural frame. The adjustable support section panels 12, 16 and 18 are mounted on the respective support frames 20*a*, 20*b* for adjustment of their relative angular positions relative to the base to alter the configuration of the bed. The mounting of the respective panels on the base is described in more detail below The base 20 constitutes the floor standing part of the bed 10 and in this respect the frames 20*a*, 20*b* may stand directly on the floor or be provided with castors, feet or the like at the corners of the rectangular frames, as is well known in the art.

The left and right hand side panels 22 and 24 of each frame 20*a*, 20*b* are symmetrically identical such that the mounting arrangement on one side of the bed is the same as the other.

Figure 3:
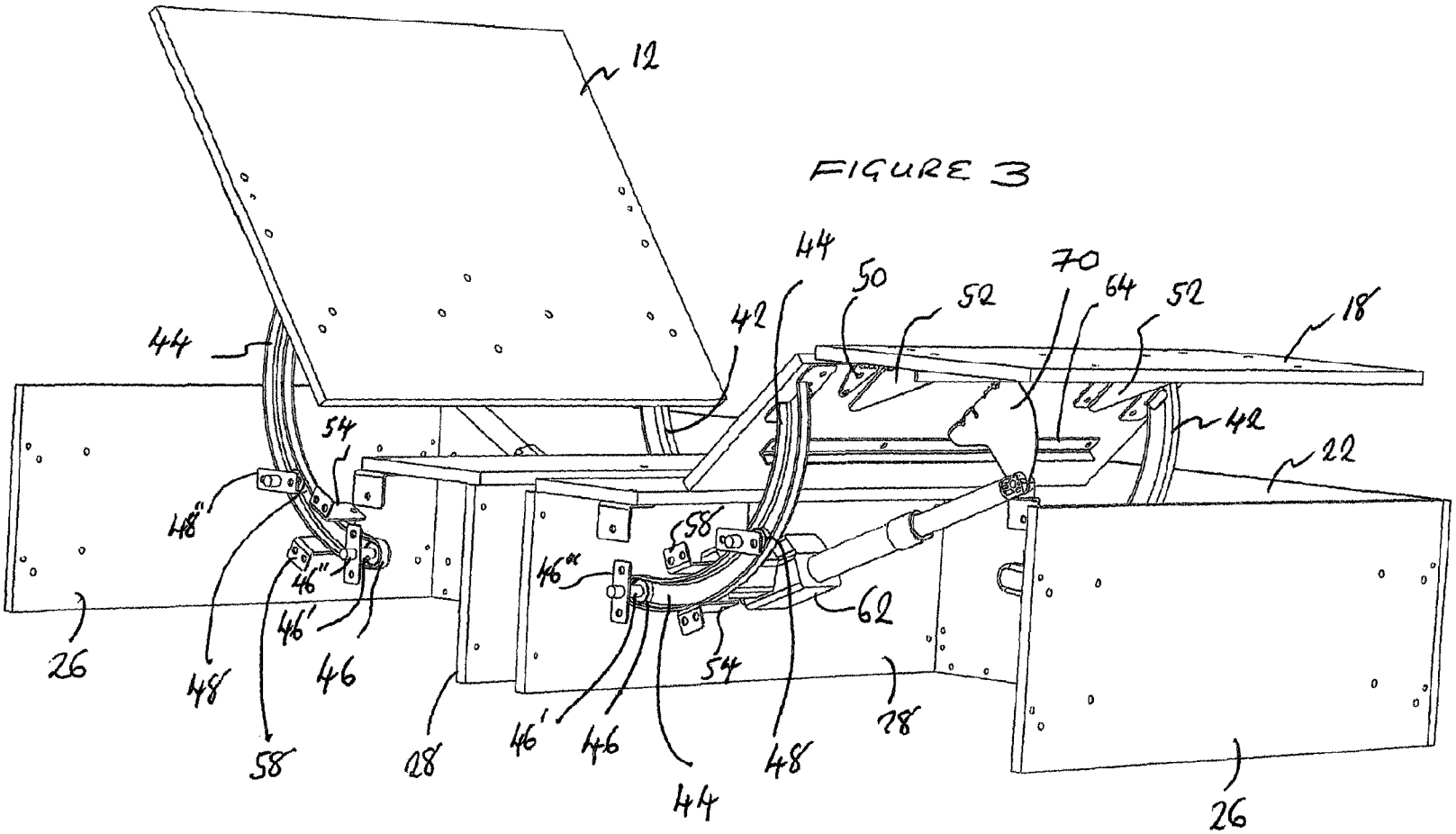
FIG. 3 is a perspective view from the side of the bed of FIGS. 1 and 2, with side panels removed for clarity.

As can best be seen in FIG. 3, the side panels 22 and 24 include bearings means on which the respective adjustable support section panels are mounted. A pair of roller bearings 46, 48 are mounted on respective bearing pins 46', 48' at circumferentially spaced locations on the respective side panels 22, 24. Bearing 46 and the associated pin 46' are positioned at the 6 o'clock position on both frames 20, 20*b*. Bearing and pin 48, 48' are positioned at a rearward position (e.g. 7 o'clock) on the rearward frame section 20*a*, and at a forward position (e.g. 5 o'clock) on the forward frame section 20*b*, thus the bearings 46, 48 are spaced approximately 30 to 45 degrees apart on a circumference centered above the base, typically at a centre corresponding to an anatomical hip pivot point of a person's body on the bed in the case of the frame section 20*a*, and at a centre corresponding to an anatomical knee pivot point of a person's body on the bed in the case of frame section 20*b*.

The roller bearings 46, 48 are located on the inward facing side of the respective side panels 22, 24, that is to say the side of the side panels facing the interior of the underside of the bed. Bearing pins 46' and 48' are attached to the respective side panels by means of respective metal brackets 46", 48" which are arranged to receive the respective bearing pins 46', 48'.

The panels 22, 24 are joined together at their respective ends by end panels 26 and 28. End panels 26 have a depth dimension substantially the same as the depth of the side panels such that they combine with the side panels to define an upstanding edge 19 around the base of the bed. Adjacent end panels 28 have a depth dimension which is slightly less so that a continuous recess 21 is defined within the boundary of the peripheral side and end panels on the upward facing side of the base when the two half frame sections 20*a*, and 20*b* are joined together.

The back support section panel 12 is pivotally mounted to the half frame section 20*a* by means of a pair of load bearing support members in the form of curved arcuate U-section guides or radial arms 42, 44 connected to and extending from the underside of the panel 12 on respective opposite lateral sides of the panel. The load bearing support members or curved guides 42, 44 are spaced apart and located at laterally spaced positions on the panel 12 close to the lateral side edges thereof so that they lie closely adjacent to the respective side panels 22, 24. The open sides of the U-section guide channels face the respective inward facing sides of the adjacent side panels 22, 24 and accommodate the respective roller bearings 46, 48. The curved guides have the same radius of curvature and lie on the same circumference as the respective bearings 46, 48 so that the bearings locate, and are held captive in, the respective open U-section channels of the curved guides and thereby provide a suitable rotational mounting for the back support section panel about a respective pivot axis defined by the centre of curvature of the respective curved guides 42, 44. This can best been seen in the drawing of FIG. 3 where the respective curved guides 42, 44 are shown with the right hand side panels 24 removed to reveal the roller bearings 46, 48 located in the open channels of the curved guides 44.

The thigh section support panel 16 is similarly pivotally mounted to the half frame section 20*b* by means of a pair of load bearing support members in the form of curved arcuate U-section guides or radial arms 42, 44 connected to and extending from the underside of the panel 16 on respective opposite lateral sides thereof. The load bearing support members or curved guides 42, 44 are spaced apart and located at laterally spaced positions on the panel 16 close to the lateral side edges thereof so that they lie closely adjacent to the respective side panels 22, 24. The open sides of the U-section guide channels face the respective inward facing sides of the adjacent side panels 22, 24 and accommodate the respective roller bearings 46, 48. The curved guides have the same radius of curvature and lie on the same circumference as the respective bearings 46, 48 so that the bearings locate, and are held captive in, the respective open U-section channels of the curved guides and thereby provide a suitable rotational mounting for the thigh support section panel about a respective pivot axis defined by the centre of curvature of the respective curved guides 42, 44.

The seat section support panels 14, 14*b* are fixed with respect to the side panels 22, 24 and end panel 28 of the respective frame sections by means of suitable brackets of the like. The seat section support panels 14, 14*b* are disposed immediately between the back and thigh support panels 12 and 16 in the assembled configuration of the base 20. The lower leg section support panel 18 is pivotally connected to the thigh support panel 16 along the respective adjoining edges of the panels by hinges 50. A pair of so called knee-break angled brackets 52 are attached to the underside of the panel 16 at the edge adjacent to the lower leg/foot rest panel 18 so that the panel 18 has a maximum degree of angular adjustment with respect to the panel 16 when the panel 16 is raised. The angled face 53 of the bracket 52 acts as an abutment stop when it comes into engagement with the underside of the panel 18 when panel 16 is raised to a position where engagement occurs. Thus, further raising of the panel 16 causes the panel 18 to lift completely above the frame 20 and remain at a pre-determined angle relative to the panel 16.

Figure 2:
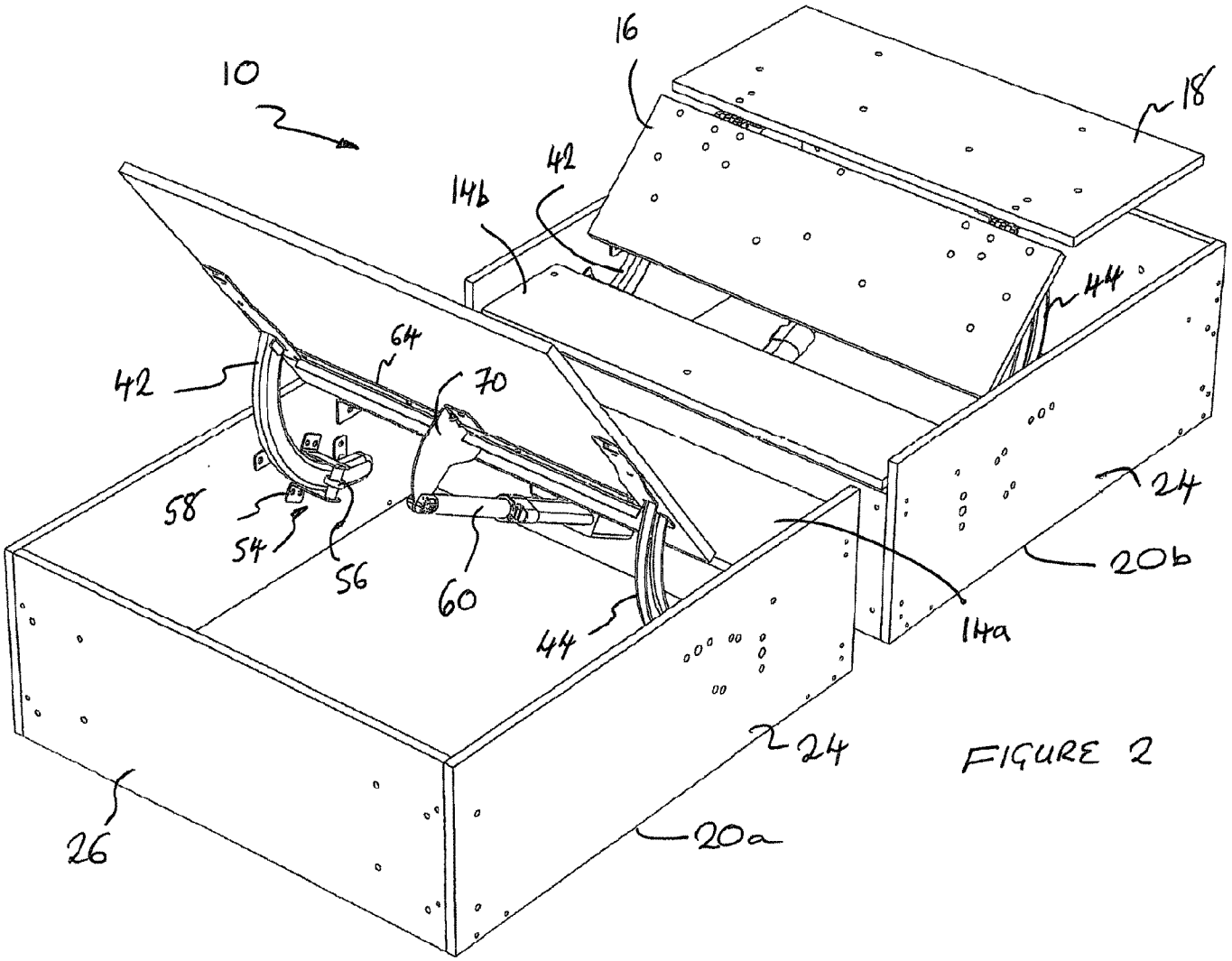
FIG. 2 is a perspective view from the rear of the bed of FIG. 1.
Figure 4:
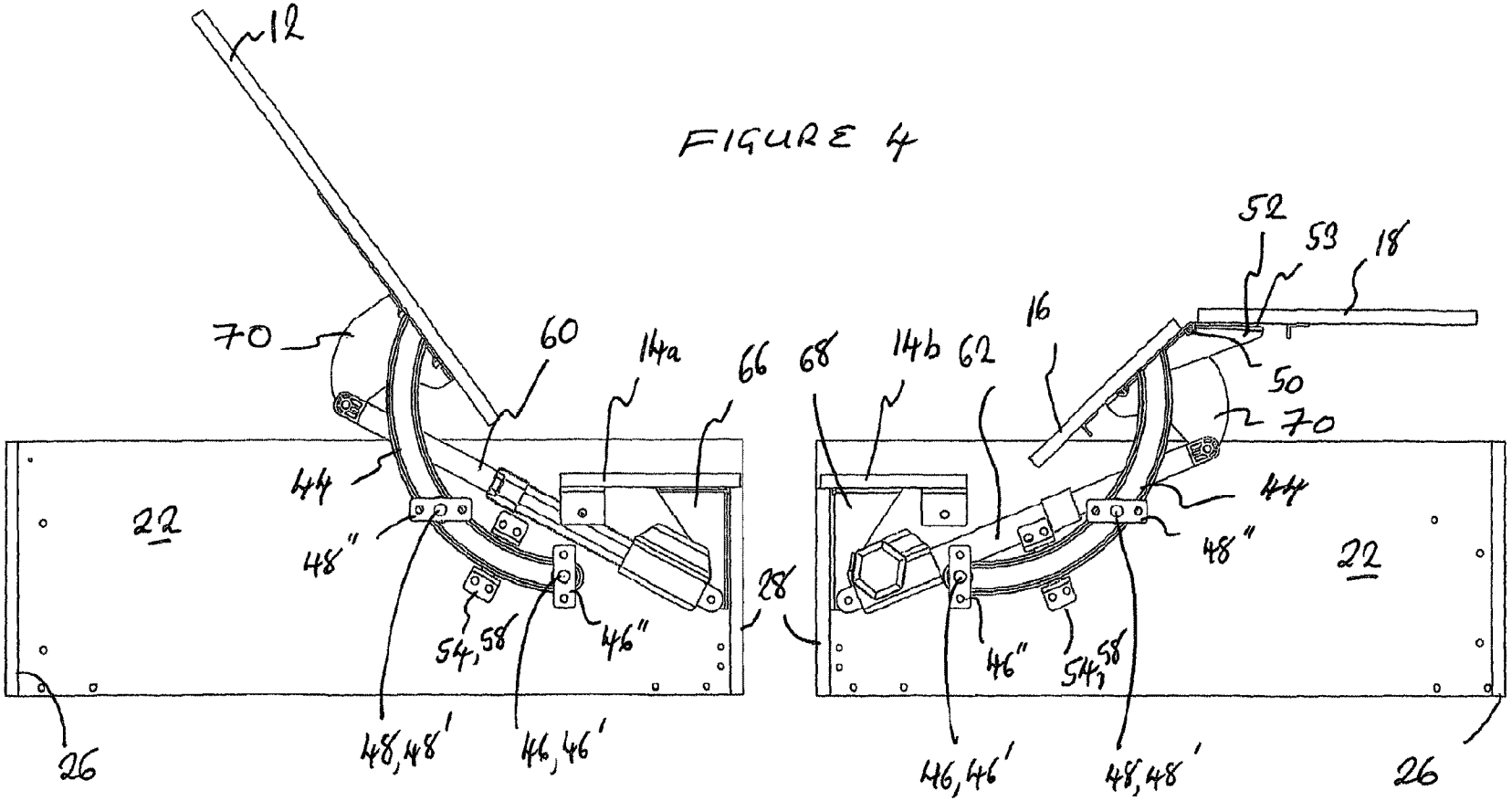
FIG. 4 is a side elevation of the bed of FIGS. 1 to 3, with side panels removed for clarity.

As can best be seen in FIGS. 2, 3 and 4 captivating means 54 are provided at the location of each curved guide 42, 44 for maintaining engagement of the curved guide on the respective roller bearings 46, 48. The captivating means 54 comprises a roller bearing 56 mounted on a bracket 58 that is fixed to the respective side panel 22, 24. The roller bearing 56 bears against the inward facing surface of the respective guide 42, 44 to maintain the curved guide in the plane of the bearings 46, 48 and thereby prevent sideways lateral movement of the curved guide with respect to the adjacent side panel 22, 24. Each bearing 56 is mounted between the bearings 46, 48 at each respective location. In particular the bearing 56 is positioned midway between the respective bearings 46, 48 so that a substantially equal force is applied to the curved guide at the location of the bearings 46, 48. This is beneficial in terms of preventing distortion of the curved guide in use due to uneven loading or weight distribution on the respective movable panels 12, 16 and 18. Each bearing 56 is mounted in a plane that is perpendicular and tangential to the respective guide so that the bearing runs freely along the radial face of the curved guide facing the interior of the frame on the underside of the bed.

Figure 5:
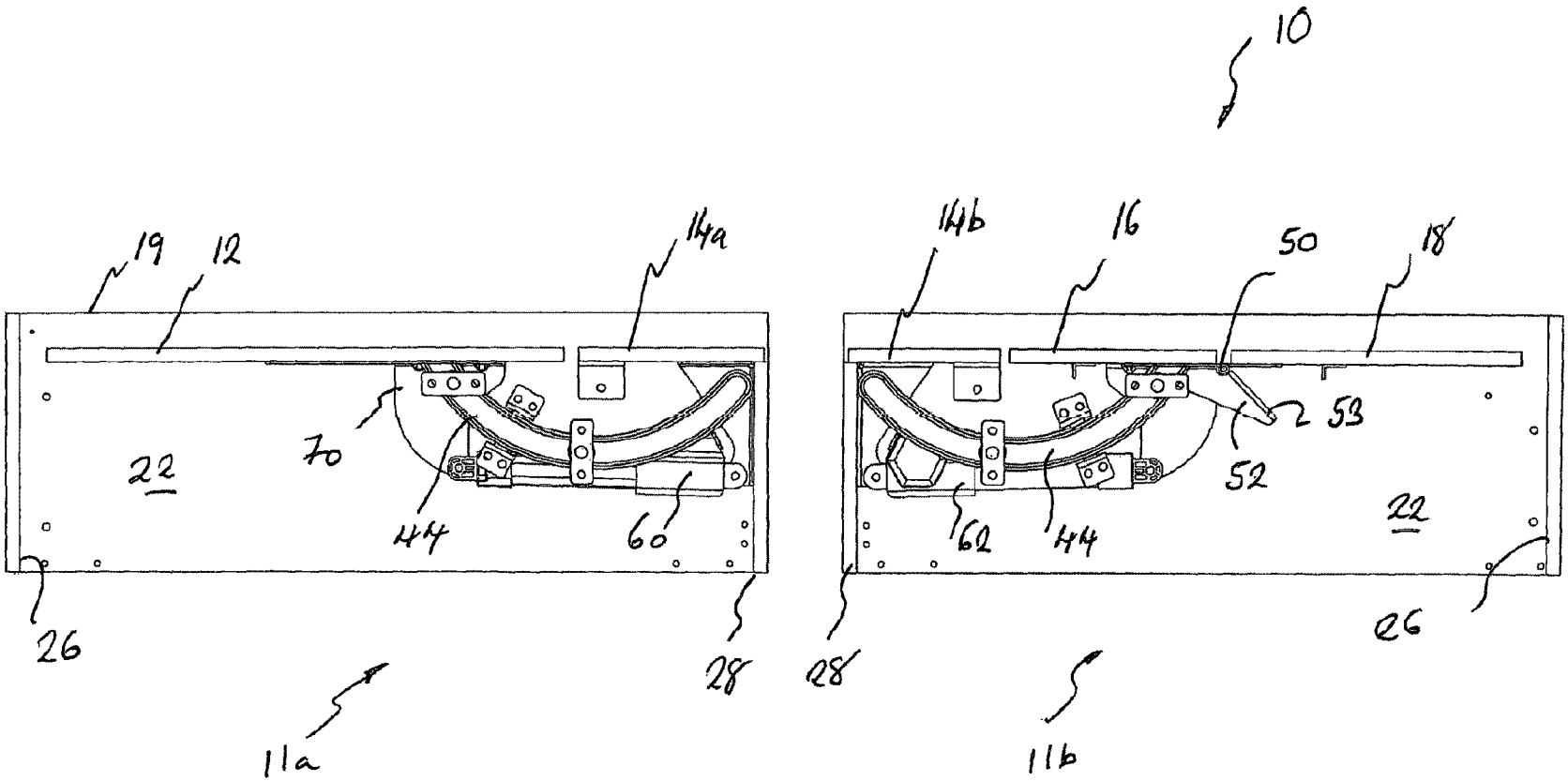
FIG. 5 is a side elevation view of the bed of FIGS. 1 to 4, similar to that of FIG. 4, with the bed in a lowered configuration.
Figure 6:
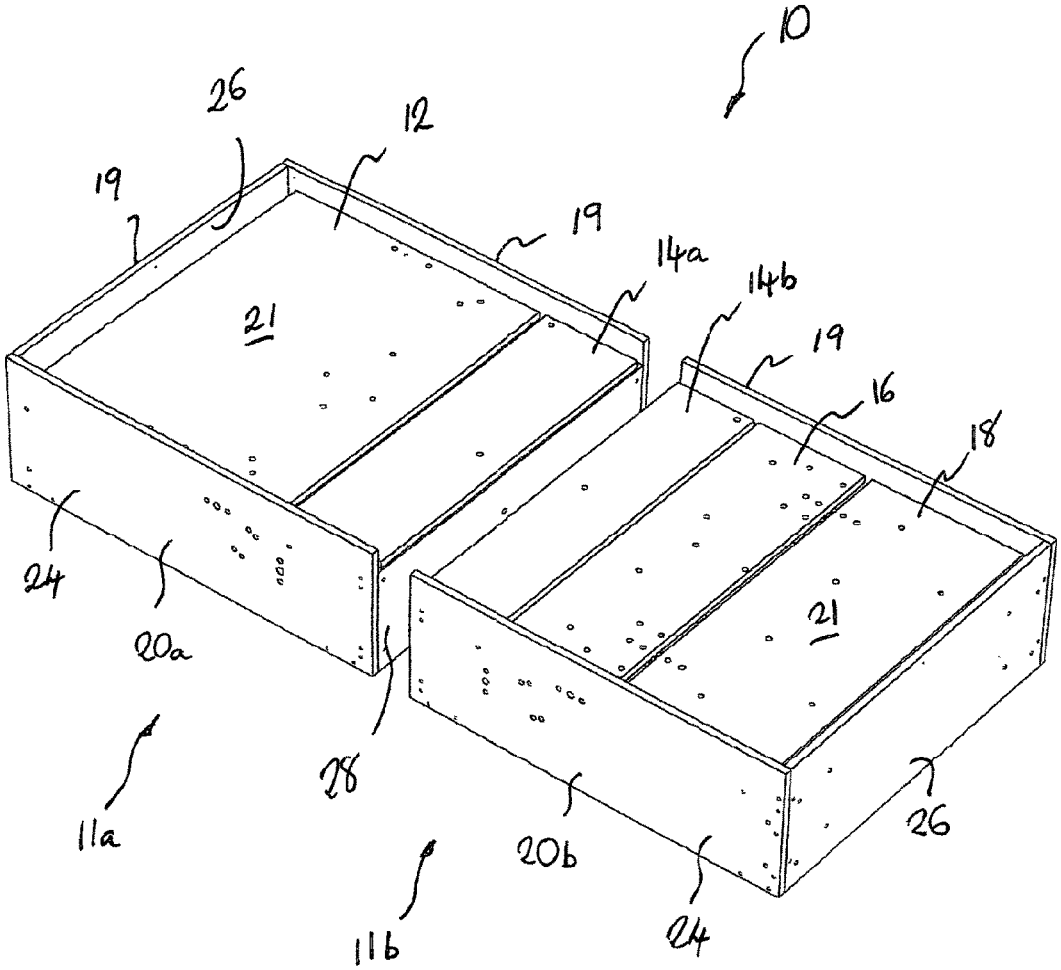
FIG. 6 is a perspective view from above of the bed of FIGS. 1 to 5, similar to that of FIG. 1, with the bed in a lowered configuration.

Movement of the panels 12, 16 and 18 is effected by linear electrical actuators 60, 62 mounted on the underside of the bed within the space envelope of the respective frame sections 20*a*, 20*b*. Linear actuator 60 has a first end secured to bracket 70 depending from a cross-member 64 on the underside of the panel 12, substantially at a mid-point along the length of the panel 12, and a second end secured to a bracket 66 depending from the underside of the panel 14*a*. Similarly, linear actuator 62 has a first end also secured to a bracket 70 depending from or in the region of a cross-member 64 on the underside of the panel 16, substantially at a mid-point along the length of the panel 16, and a second end secured to a bracket 68 depending from the underside of the panel 14*b*. Thus panel 12 is raised and lowered by respective extension and retraction of actuator 60 and panel 16, with attached panel 18, is raised and lowered by respective extension and retraction of actuator 62. As can be seen in FIGS. 5 and 6 when the actuators are fully retracted they lie substantially horizontally within the interior region of the base with the respective adjustable panels 12, 16 and 18 lying flat and horizontal in the plane of the fixed panels 14*a*, 14*b*. It will be understood that the actuators 60 and 62 may be operated selectively, either in unison or independently to re-configure the bed according to a desired configuration. In addition, it will be understood that two single size beds of the same or similar construction may be arranged side by side, and possibly connected together, to provide a double size bed with each side having independent movement.

Figure 7:
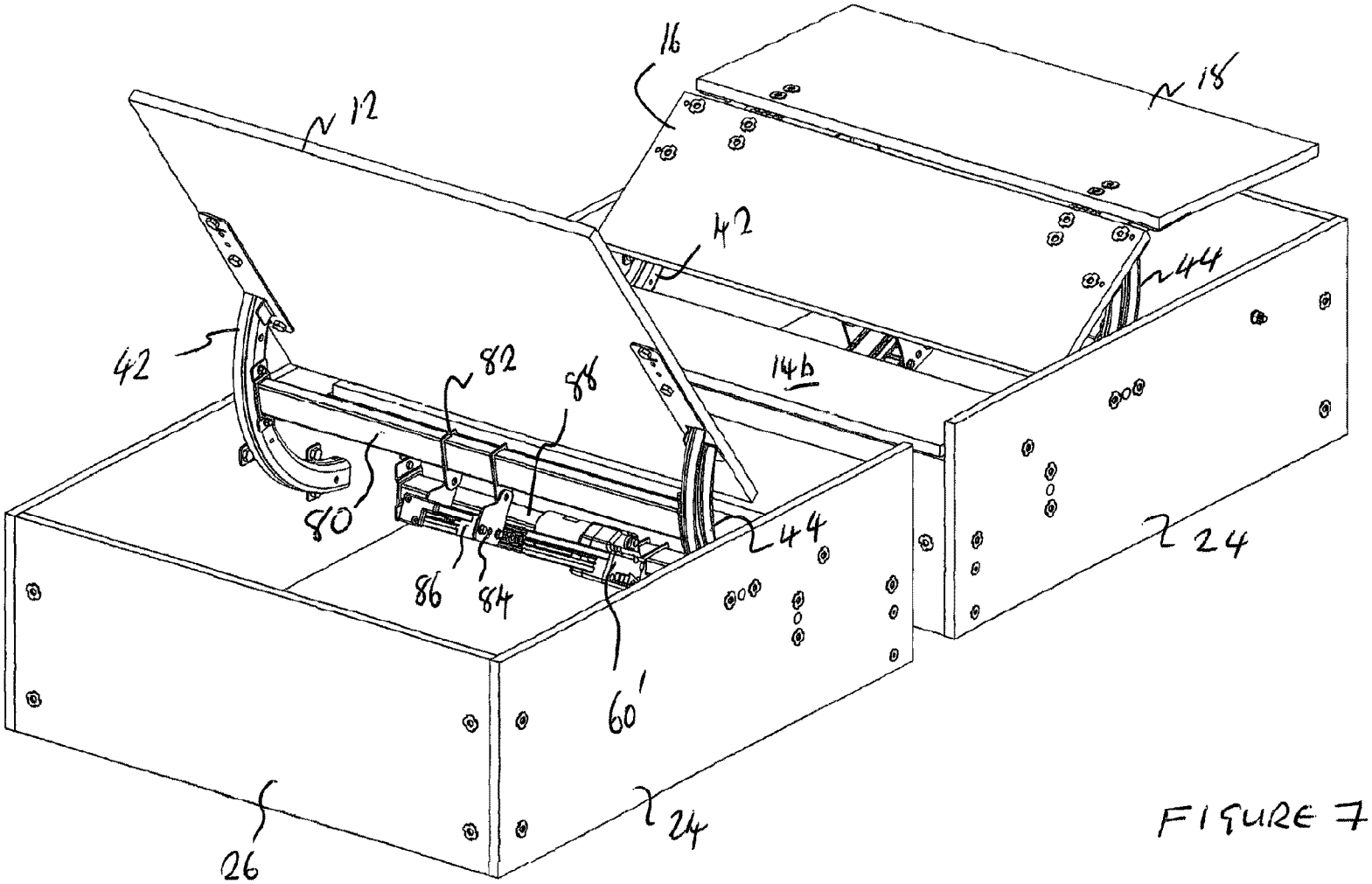
FIG. 7 is a perspective view from the rear of an adjustable bed according to a second embodiment of the invention, with the bed in a raised configuration.
Figure 8:
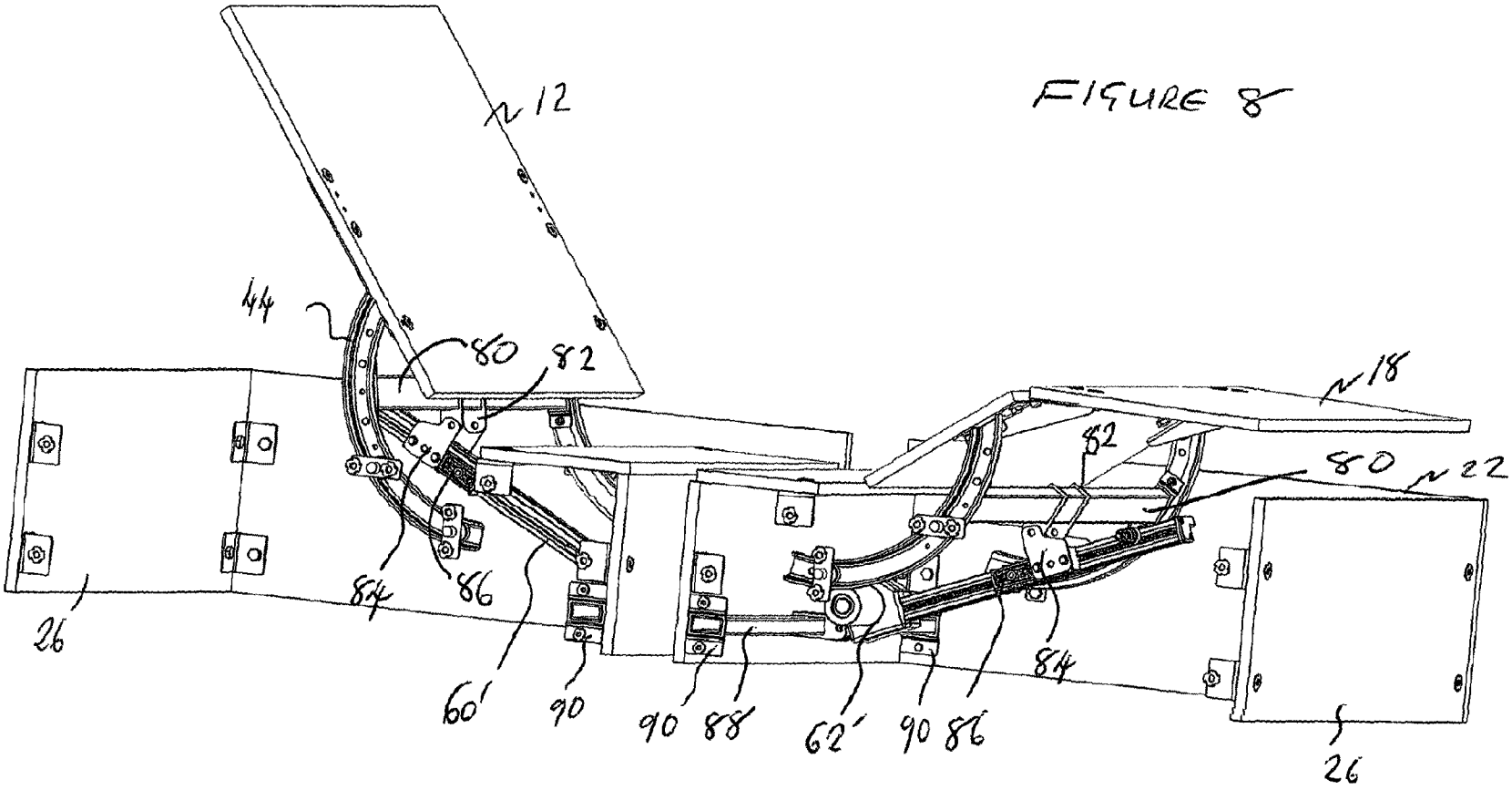
FIG. 8 is a perspective view from the side of the bed of FIG. 7, with side panels removed for clarity.
Figure 9:
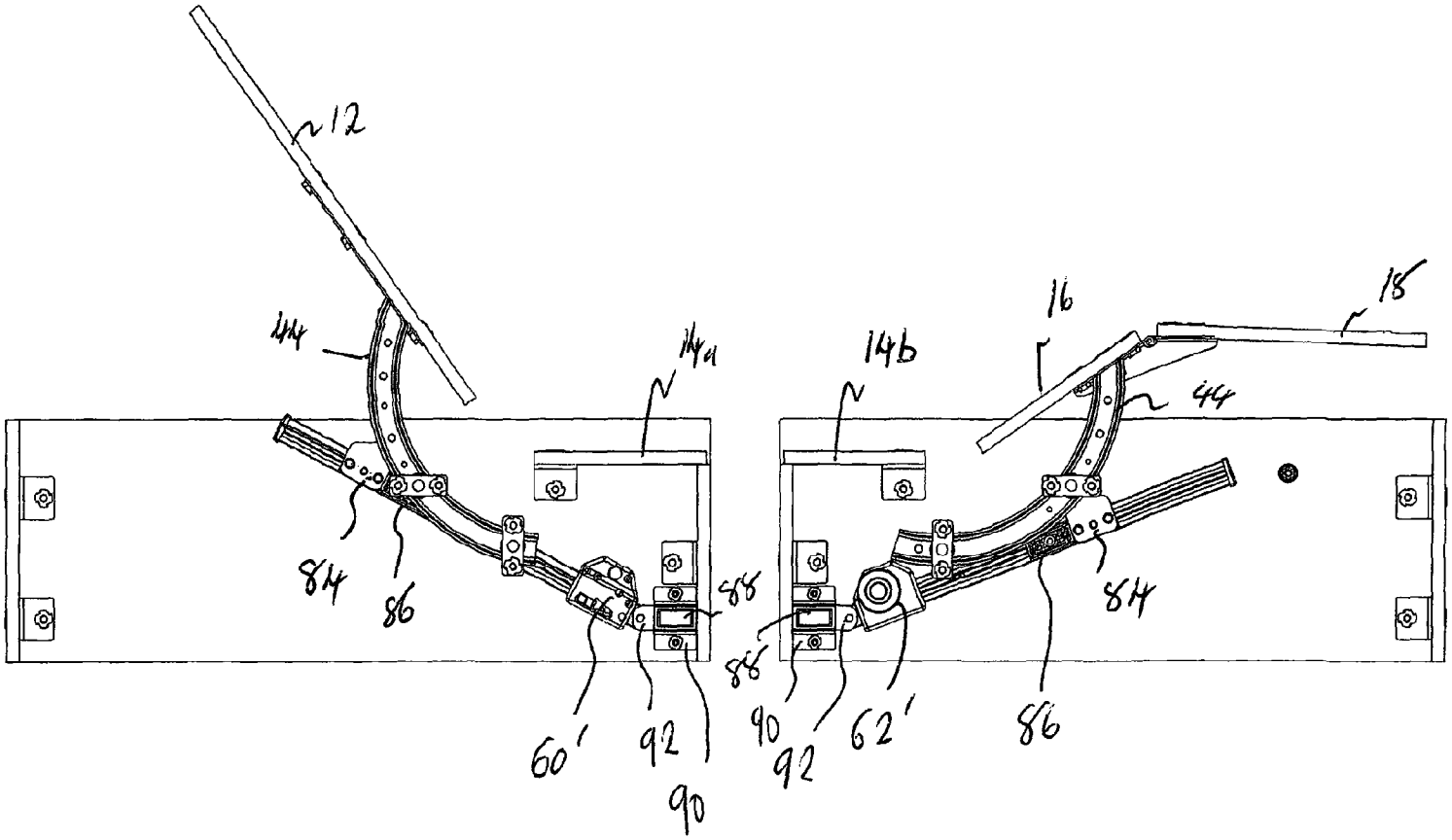
FIG. 9 is a side elevation of the bed of FIGS. 7 and 8, with side panels removed for clarity.

A modified embodiment (second embodiment) of an adjustable bed is shown in the drawings of FIGS. 7 to 9. FIG. 7 is an isometric view of the modified bed similar to the view of FIG. 2, that is to say a three quarter view from the rear. FIG. 8 is a similar view to that of FIG. 8 and FIG. 9 is similar to the view of FIG. 4. The same reference numbers designate like parts throughout.

The embodiment of FIGS. 7 to 9 differs from the embodiment of FIGS. 1 to 6 previously described in that the curved guide radial arms 42, 44 are rigidly connected together not only by the respective panels 12, 16 but also by means of an elongate transversely extending connecting member 80 in the form of a box section tube. Each tube 80 is connected to the inward facing flat surface of the radial arms 42, 44, nearer the end of the radial arms connected to the respective panel 12,16. Each tube 80 is provided with a mounting bracket 82 midway along its length for pivotal connection to an actuator mounting bracket 84 connected to a moving block 86 of a respective actuator 60',62'. Actuators 60', 62' are Betadrive actuators manufactured by Dewert Okin and are each pivotally connected to a respective box section mounting tube 88 extending between the respective lateral side panels 22, 24. The end of each actuator 60', 62' containing the electric motor is pivotally connected to a mounting bracket 92 fixedly secured to the mounting tube 86 midway along the length of the tube. Each tube 88 is fixedly secured to respective side panels 22, 24 by means of respective mounting brackets 90. This modified arrangement provides a stiff structural support arrangement which resists twisting and bending and replaces, in the previous embodiment, the captivating means 54 comprising the bearing 56 bracket 58 associated with each curved guide radial arm 42, 44.

It is to be understood that the adjustable bed shown in the illustrated embodiments is a domestic adjustable bed, that is to say an adjustable bed for the home setting.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. A modular adjustable bed system, comprising:

a frame;

wherein the frame further comprises:

at least two self-contained modular self-supporting sections;

each of said self-contained modular self-supporting sections defining a shared respective flat continuous support plane relative to an external bed support surface;

a first of said self-contained modular self-supporting sections including a head end sub-assembly configured as an upper body supporting section on which an adjustable backrest support section is movably mounted within said head end sub-assembly between a flat continuous support position positioned aligned with said flat continuous support plane and a backrest support position;

said upper body support section further comprising an upper body fixed support section adjacent said backrest support section and fixably spanning respective sides of said first of said first of said self-contained modular self-supporting sections;

said upper body fixed support section positioned along said flat continuous support plane; and a first upper body actuator means contained within said upper body supporting section providing an angular adjustment of said backrest support section during a use;

a second of said self-contained modular self-supporting sections including a separate toe end sub-assembly configured as a lower body supporting section on which at least one lower body support section is movably mounted within said toe end sub-assembly between said flat continuous support position aligned with said flat continuous support plane and a lower body support position;

said lower body supporting section further comprising a lower body fixed support section adjacent said lower body support section and fixably spanning respective sides of said second of said self-contained modular self-supporting sections;

said lower body fixed support section positioned along said flat continuous support plane;

a second lower body actuator means contained within said lower body supporting section providing an angular adjustment of said at least one lower body support section during said use; and wherein said head end sub-assembly and said toe end sub-assembly being attachably and detachably joinable together so that upon an attachment during said use said backrest support section, said upper body fixed support section, said lower body support section and said lower body fixed support section are aligned with said flat continuous support plane.

2. The modular adjustable bed system, according to claim 1, wherein:

said backrest support section has a hinged end; and said upper body fixed support section adjacent said hinged end of said backrest support section.

3. The modular adjustable bed system, according to claim 1, wherein:

said at least one lower body support section further comprising:

an adjustable upper leg/thigh support section and an adjustable lower leg/calf and foot support section.

4. The modular adjustable bed support system, according to claim 3, wherein:

said adjustable upper leg/thigh support section is pivotally connected to said adjustable lower leg/calf and foot support section.

5. The modular adjustable bed support system, according to claim 4, wherein:

said adjustable lower leg/calf and foot support section is arranged to pivot apart from said adjustable upper leg/thigh support section during an angular adjustment of said adjustable upper leg/thigh support section; and said adjustable lower leg/calf support, further comprises:

an abutment stop that prevents a further angular adjustment of said lower leg/calf and foot support section with respect to said adjustable upper leg/thigh support section at a predetermined angle of adjustment relative to said adjustable upper leg/thigh support section.

6. The modular adjustable bed support system, according to claim 3, wherein:

said upper leg/thigh support section further comprises a hinged end; and said a lower body fixed support section adjacent said hinged end of said upper leg/thigh support section.

7. The modular adjustable bed support system, according to claim 1, further comprising:

at least a first upper body bearing member on said upper body supporting section;

said at least first upper body bearing member projecting downward from said upper body support section below said shared respective flat continuous support plane;

said first upper body bearing member being supported by a first upper body bearing means arranged to run on a first upper body curved guide part thereof such that said adjustable backrest support section is pivotally mounted with respect to said frame about an upper body pivot axis defined by a center of curvature of said first upper body curved guide part;

at least a first lower body bearing member on said lower body supporting section;

said at least first lower body bearing member projecting downward from said lower body member below said shared respective flat continuous support plane; and said first lower body bearing member being supported by a first lower body bearing means arranged to run on a first lower body curved guide part thereof such that said one lower body support section is pivotably mounted with respect to said frame about a lower body pivot axis defined by center of curvature of said first lower body curved guide part.

8. The modular adjustable bed support system, according to claim 7, wherein:

at least one of said first upper body bearing means and said first lower body bearing means is carried by a respective one of said upper body bearing member and said lower body bearing member; and at least one of said upper body curved guide and said lower body curved guide is proximate a slot in said frame.

9. The modular adjustable bed support system, according to claim 7, wherein:

each of said first upper body bearing means and said first lower body bearing means carried by said frame;

said upper body curved guide provided on said upper body bearing member; and said lower body curved guide provided on said lower body bearing member.

10. The modular adjustable bed support system, according to claim 7, wherein:

each of said at least two self-contained modular self-supporting sections including at least a pair of side panels; and each one of said upper body curved guide and said lower body curved guide on said at least one of respective said pairs of side panels.

11. The modular adjustable bed support system, according to claim 7, wherein:

said at least first upper body bearing member, further comprises:

a second upper body curved guide part and a second upper body bearing means;

said first and said second upper body curved guide parts on respective opposed lateral sides of said upper body supporting section;

a first and said second upper body bearing means on respective opposed lateral sides of said frame;

said first and said second upper body curved guide parts being arranged to run on respective said first and said second upper body bearing means to permit an angular adjustment about said upper body pivot axis during said use; and said at least first lower body bearing member, further comprises:

a second lower body curved guide part and a second lower body bearing means;

said first and said second lower body curved guide parts on respective opposed lateral sides of said lower body supporting section;

a first and said second lower body bearing means on respective opposed lateral sides of said frame; and said first and said second lower body curved guide parts being arranged to run on respective said first and said second lower body bearing means to permit an angular adjustment about said lower body pivot axis during said use.

12. The modular adjustable bed support system, according to claim 1, wherein:

said upper body support section and said lower body support section each contain a separate box type frame structure having a pair of lateral side panels enclosing a respective upper body support inner region and a lower body support inner region;

each said box type frame structure including an end panel joining respective lateral side panels;

said upper body fixed support section fixably joining respective said pair of said lateral side panels of said upper body support section; and said lower body fixed support section fixably joining respective said pair of said lateral side panels of said lower body support section.

* * * * *